US008686878B2

(12) United States Patent
Whitlow et al.

(10) Patent No.: US 8,686,878 B2
(45) Date of Patent: Apr. 1, 2014

(54) SYSTEMS AND METHODS FOR CONTEXT SENSITIVE NOTIFICATION

(75) Inventors: Stephen Whitlow, St. Louis Park, MN (US); Trent Reusser, New Brighton, MN (US)

(73) Assignee: Honeywell International Inc., Morristown, NJ (US)

( * ) Notice: Subject to any disclaimer, the term of this patent is extended or adjusted under 35 U.S.C. 154(b) by 40 days.

(21) Appl. No.: 13/565,933

(22) Filed: Aug. 3, 2012

(65) Prior Publication Data

US 2014/0035763 A1 Feb. 6, 2014

(51) Int. Cl.
*G08B 21/00* (2006.01)

(52) U.S. Cl.
USPC ..... 340/945; 340/963; 340/971

(58) Field of Classification Search
USPC ..... 340/945, 963, 964, 967–979, 539.1, 340/286.02, 286.04; 370/389, 396; 726/27
See application file for complete search history.

(56) References Cited

U.S. PATENT DOCUMENTS

| | | | | |
|---|---|---|---|---|
| 4,409,439 | A | 10/1983 | Gamble | |
| 5,870,684 | A | 2/1999 | Hoashi et al. | |
| 6,084,959 | A | 7/2000 | Yun | |
| 7,136,482 | B2 | 11/2006 | Wille | |
| 7,237,268 | B2 * | 6/2007 | Fields | 726/27 |
| 7,254,837 | B2 * | 8/2007 | Fields | 726/27 |
| 7,269,503 | B2 | 9/2007 | McGrath | |
| 7,281,215 | B1 * | 10/2007 | Canfield et al. | 715/752 |
| 7,343,150 | B2 | 3/2008 | Seligmann et al. | |
| 7,454,009 | B2 | 11/2008 | Aupperle et al. | |
| 7,769,811 | B2 | 8/2010 | Heikes et al. | |
| 7,877,697 | B2 * | 1/2011 | Canfield et al. | 715/753 |
| 8,116,826 | B2 | 2/2012 | Kraft et al. | |
| 2003/0027605 | A1 | 2/2003 | Hijii | |
| 2004/0253993 | A1 | 12/2004 | Nakamura | |
| 2005/0181838 | A1 | 8/2005 | Matsuda et al. | |
| 2008/0304479 | A1 * | 12/2008 | Scott et al. | 370/389 |
| 2008/0304491 | A1 * | 12/2008 | Scott et al. | 370/396 |
| 2010/0081481 | A1 | 4/2010 | Hirokawa | |
| 2011/0123017 | A1 | 5/2011 | Fitchmun | |
| 2012/0075122 | A1 | 3/2012 | Whitlow et al. | |
| 2012/0075124 | A1 | 3/2012 | Whitlow et al. | |

* cited by examiner

*Primary Examiner* — Van T. Trieu
(74) *Attorney, Agent, or Firm* — Ingrassia Fisher & Lorenz, P.C.

(57) ABSTRACT

Methods and apparatus are provided for context sensitive notifications of incoming digital communications on an aircraft. The method comprises receiving a new datalink message from a sender on a device, the datalink message including a unique identifier associated with the sender, and determining if the sender is a new sender based on the unique identifier. The method comprises determining if the device is involved in an active exchange of datalink messages based on activity data associated with the device and outputting a first alert that the new datalink message has been received at an alert level below a current alert level if the sender is not a new sender and the device is engaged in the active exchange of datalink messages.

20 Claims, 3 Drawing Sheets

SYSTEMS AND METHODS FOR CONTEXT SENSITIVE NOTIFICATION

TECHNICAL FIELD

The present disclosure generally relates to notifications provided upon receipt of digital communications, and more particularly relates to systems and methods for context sensitive notification for incoming digital communications.

BACKGROUND

Currently, digital communications can be received on a variety of electronic devices. In one example, a pilot can receive digital communications, such as datalink messages, on an electronic device in a cockpit of an aircraft. Datalink messages can provide the pilot with enhanced information regarding the operation of the aircraft, and can often replace traditional radio transmissions as a method of communication between the pilot and ground facilities. Generally, when a datalink message is received, an alert can be broadcast into the cockpit to notify the pilot that a new message has been received. Typically, this alert can be repeated at the same notification level for each new message received, even if the pilot is actively engaged in responding to incoming digital communications.

Hence, there is a need for context sensitive notifications for incoming digital messages, which can reduce disruptions when the pilot is actively engaged in responding to incoming digital communications.

BRIEF SUMMARY

An apparatus is provided for a computer program product for processing a digital signal. The apparatus comprises a tangible storage medium readable by a processing circuit and storing instructions for execution by the processing circuit for performing a method comprising: receiving a new datalink message having a unique sender identifier, determining if the sender is a new sender based on the unique sender identifier, determining if an active exchange of datalink messages is occurring on a device, determining if the device is active, and outputting an alert that the new datalink message has been received at an alert level below a current alert level if an active exchange of datalink messages is occurring, the sender is not a new sender and the device is active.

A method is provided for context sensitive notifications of incoming digital communications using a device onboard an aircraft for receiving and sending a datalink message, in which the device includes a user input device. The method comprises providing a device on an aircraft for receiving and sending a datalink message. The device can include a user input device. The method can also include receiving a new datalink message from a sender on the device, the datalink message including a unique identifier associated with the sender, and determining if the sender is a new sender based on the unique identifier. The method can also comprise determining if the device is involved in an active exchange of datalink messages based on activity data associated with the device and outputting a first alert that the new datalink message has been received at an alert level below a current alert level if the sender is not a new sender and the device is engaged in the active exchange of datalink messages. Further, the method can include determining if a response has been received via the user input device to the new datalink message and outputting a second alert that the new datalink message has been received at an alert level above a current alert level if no response has been received via the user input device.

Furthermore, other desirable features and characteristics of the systems and methods will become apparent from the subsequent detailed description and the appended claims, taken in conjunction with the accompanying drawings and the preceding background.

BRIEF DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the present disclosure or the application and uses of the present teachings. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the present teachings and not to limit the scope of the present disclosure which is defined by the claims. Furthermore, there is no intention to be bound by any expressed or implied theory presented in the preceding technical field, background, brief summary, or the following detailed description.

Figure 1:
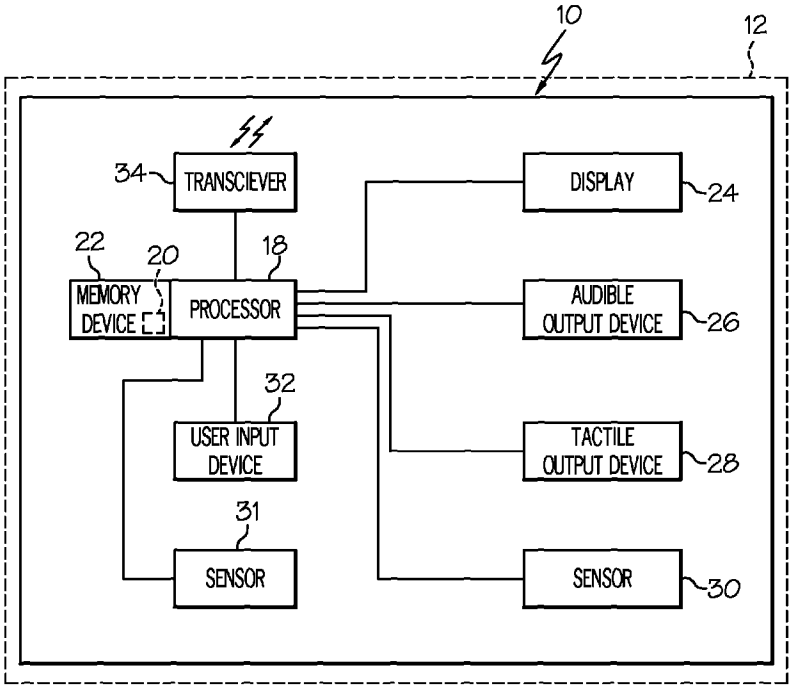
FIG. 1 is a functional block diagram illustrating a device on an aircraft that includes a context sensitive notification system in accordance with an exemplary embodiment.

With reference to FIG. 1, a device 10 for use on an aircraft 12 is shown. The device 10 can comprise any suitable electronic device for receipt of electronic communications, such as a cellular phone, handheld computing device, personal digital assistant, electronic flight deck, etc., which can be used on the aircraft 12. In one example, the device 10 can send and receive one or more datalink messages from a ground station, such as an air traffic control station. The device 10 can include a processor 18 for performing a context sensitive notification system 20 (FIG. 2), which can be stored in a memory device 22. As will be discussed herein, the context sensitive notification system 20 can notify an operator of the device 10 of the receipt of a datalink message from the ground station according to the context of the communication. It should be noted that although the context sensitive notification system 20 is described and illustrated herein as being used with a device 10 on an aircraft 12, the context sensitive notification system 20 could also be employed with ground based messaging schemes, such as instant messaging, text messaging over cellular networks, etc. Furthermore, the context sensitive notification system 20 could be employed with messages received from a public broadcast system. With continued reference to FIG. 1, the device 10 can include the processor 18, the memory device 22, a display 24, an audible output device 26, tactile output device 28, first sensor 30, second sensor 31 and user input device 32. The device 10 can also include a transceiver 34, which can enable communications between the device 10 and the ground station (e.g. air traffic control station).

The processor 18 of the illustrated embodiment is capable of executing one or more programs (i.e., running software) to perform various tasks instructions encoded in the program(s). The processor 18 may be a microprocessor, microcontroller, application specific integrated circuit (ASIC) or other suitable device as realized by those skilled in the art. Of course, the device 10 may include multiple processors 18, working together or separately, as is also realized by those skilled in the art.

The memory device 22 is capable of storing data. The memory device 22 may be random access memory (RAM), read-only memory (ROM), flash memory, a memory disk (e.g., a floppy disk, a hard disk, or an optical disk), or other suitable device as realized by those skilled in the art. In the illustrated embodiments, the memory device 22 is in communication with the processor 18 and stores the program(s) executed by the processor 18. Those skilled in the art realize that the memory device 22 may be an integral part of the processor 18. Furthermore, those skilled in the art realize that the device 10 may include multiple memory devices 22.

The device 10 can include the display 24. The display 24 can display various images and data, in both a graphical and textual format. In one example, the display 24 can display one or more datalink messages, and can also display an alert that indicates receipt of a datalink message according to the context sensitive notification system 20. The display 24 can also display a graphical user interface (GUI), which can enable the operator of the device 10 to compose and respond to the one or more datalink messages. The display 24 can comprise any suitable technology for displaying information, including, but not limited to, a liquid crystal display (LCD), plasma, or a cathode ray tube (CRT). The display 24 can be in communication with the processor 18 for receiving data from the processor 18. Those skilled in the art realize numerous techniques to facilitate communication between the display 24 and the processor 18.

The audible output device 26 can enable an audible alert to be broadcast to the operator upon receipt of a datalink message according to the context sensitive notification system 20. The audible output device 26 can comprise any suitable technology for broadcasting audible information, such as a speaker. It should be noted that although the audible output device 26 is illustrated herein as being internal to the device 10, the audible output device 26 could also be an external speaker coupled to or in communication with the device 10. The audible output device 26 can be in communication with the processor 18 of the device 10 to receive output an audible alert regarding the receipt of the datalink messages, as will be discussed in greater detail herein.

The tactile output device 28 can be in communication with the processor 18 to output a tactile alert to the operator upon receipt of a datalink message according to the context sensitive notification system 20. An exemplary tactile alert can comprise a vibration. In one example, the tactile output device 28 can comprise any suitable technology for generating a vibration, such as a motor that drives a gear having an offset weight as known in the art.

With continued reference to FIG. 1, the first sensor 30 can also be in communication with the processor 18. The first sensor 30 can observe whether the device 10 is being handled by the operator. In one example, the first sensor 30 can comprise an accelerometer, which can measure the acceleration of the device 10 and can generate accelerometer signals based thereon. The signals generated by the accelerometer can indicate if the device 10 is stationary, or if the device 10 is being handled by the operator. The input from the first sensor 30 can be used by the context sensitive notification system 20, as will be discussed in greater detail herein.

The second sensor 31 can observe a status of the device 10. In one example, the second sensor 31 can measure if applications are being actively used on the device 10 and can output signals that indicate whether the device 10 is active ("awake"), if the device 10 is in a stand-by mode ("asleep") or if the device 10 is in the process of powering down ("shutting off"). The second sensor 31 can be in communication with the processor 18. It should be noted that although the second sensor 31 is described herein as observing a status of the device 10, the status of the device 10 could be determined by a control module or other system within the device 10. Thus, the use of the second sensor 31 is merely exemplary.

The device 10 can also include the user input device 32. The user input device 32 can receive data and/or commands from the operator of the device 10. The user input device 32 can be in communication with the processor 18 such that the data and/or commands input by the operator can be received by the processor 18. Those skilled in the art realize numerous techniques to facilitate communication between the user input device 32 and the processor 18. The user input device 32 can be implemented with any suitable technology, including, but not limited to, a touchscreen interface (e.g., overlaying the display 24), a touch pen, a keyboard, a number pad, a mouse, a touchpad, a roller ball, a pushbutton, a switch, etc.

The processor 18 can be in communication with the transceiver 34. The transceiver 34 can send and receive data, such as one or more datalink messages. In one example, the one or more datalink messages can be transmitted via modulated radio frequency (RF) signals. In this example, the transceiver 34 can demodulate the one or more datalink messages for receipt by the processor 18. In addition, the transceiver 34 can also receive one or more datalink messages from the processor 18, and can modulate these datalink messages for transmission to the ground station (e.g. air traffic control station). It should be noted, however, that any suitable communication method could be employed to enable communication between the aircraft 12 and the ground station (e.g. air traffic control station). Further, it should be noted that although the transceiver 34 is illustrated as being separate from the processor 18, the transceiver 34 could be implemented as part of the processor 18, if desired.

The context sensitive notification system 20 can determine an alert level for a datalink message received by the device 10 based on data associated with the datalink message and signals received from the first sensor 30, second sensor 31 and user input device 32. The alert level can include a specified output for the display 24, audible output device 26 and tactile output device 28. In one example, the alert level can comprise an audible alert, a tactile alert, a graphical and/or textual alert for display on the display 24 and combinations thereof. For example, a full level alert can comprise an audible alert at a predetermined maximum volume, a tactile alert and a graphical alert. A next, first lower level alert can comprise an audible alert at a volume lower than the predetermined maximum volume and a graphical alert. A next, second lower level alert can comprise an audible alert at a volume less than the first lower level alert and a tactile alert. A next, third lower level alert can comprise an audible alert at a volume less than the second lower level alert. A next, fourth level alert can comprise no alert. In this regard, based on the context of the datalink message communication, the context sensitive notification system 20 may no longer alert the operator of the device 10 to an incoming datalink message. This can reduce interruptions in the cockpit when the operator of the device 10 is actively engaged in a conversation using the device 10. It should be noted that the alert levels described herein are merely exemplary, and further, that the alert levels could be user defined, if desired.

Figure 2:
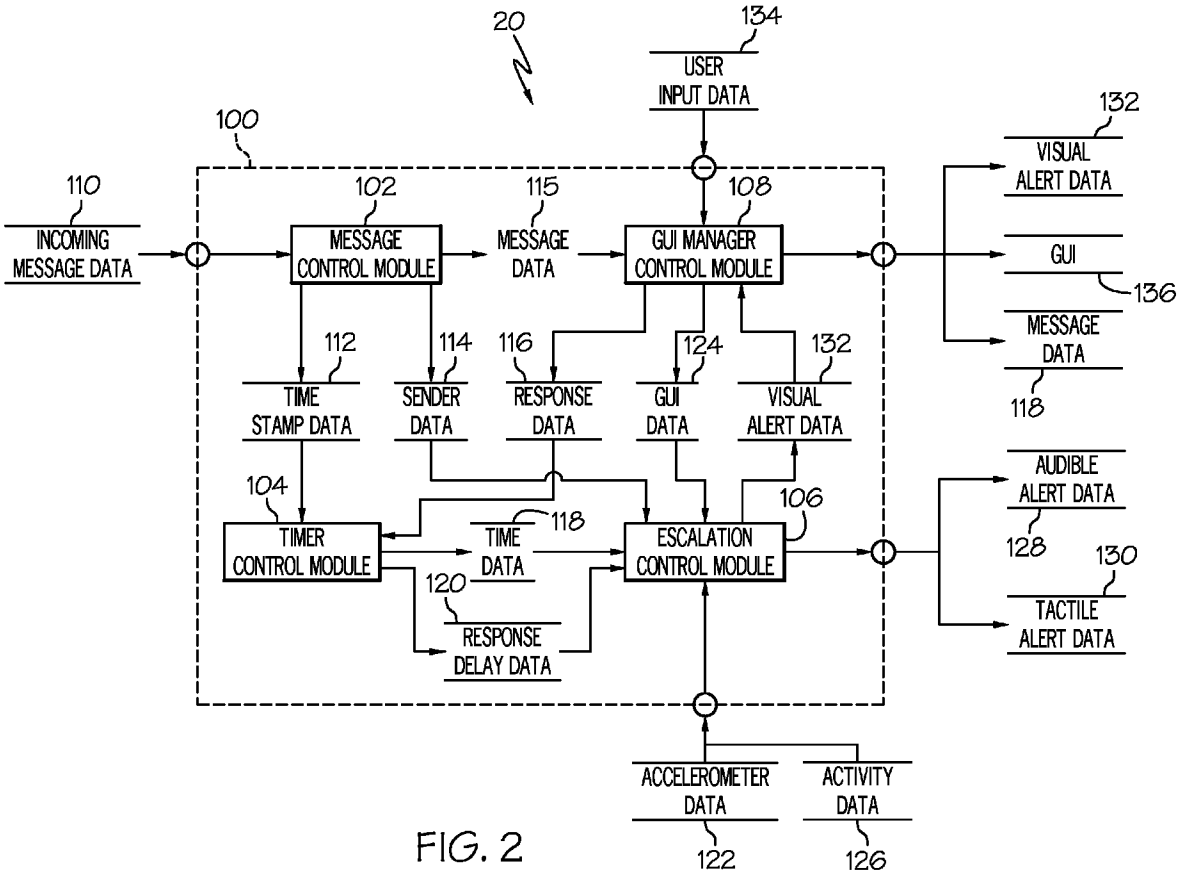
FIG. 2 is a dataflow diagram illustrating a control system of the context sensitive notification system in accordance with an exemplary embodiment.

Referring now to FIG. 2, a dataflow diagram illustrates various embodiments of the context sensitive notification system 20 that may be embedded within a control module 100 and performed by the processor 18 (FIG. 1). Various embodiments of the context sensitive notification system 20 according to the present disclosure can include any number of sub-modules embedded within the control module 100. As can be appreciated, the sub-modules shown in FIG. 2 can be combined and/or further partitioned to determine the alert output by the display 24, audible output device 26 and tactile output device 28 (FIG. 1) upon receipt of a datalink message. Inputs to the system may be sensed from the aircraft 12 (FIG. 1), received from other control modules (not shown), and/or determined/modeled by other sub-modules (not shown) within the control module 100. In various embodiments, the control module 100 can include a message control module 102, a timer control module 104, an escalation control module 106 and a GUI manager control module 108.

The message control module 102 can receive as input incoming message data 110. The incoming message data 110 can comprise a datalink message received from the ground station, which can include an identification of the sender of the datalink message. Based on the incoming message data 110, the message control module 102 can set time stamp data 112 for the timer control module 104, sender data 114 for the escalation control module 106 and message data 115 for the GUI manager control module 108. The time stamp data 112 can include data regarding when the datalink message was received by the message control module 102. The sender data 114 can include data regarding the identification of the sender of the datalink message, such as an email address, IP address, phone number, ground station location, etc. Generally, the sender data 114 can include a unique identifier of the sender, which can be transmitted with the incoming datalink message. The message data 115 can include the datalink message for display on the display 24.

The timer control module 104 can receive the time stamp data 112 from the message control module 102, and can also receive response data 116 as input. The response data 116 can include data or signals that indicate that the operator of the device 10 has responded or replied to the datalink message received from the ground station. Based on the time stamp data 112, the timer control module 104 can set time data 118 for the escalation control module 106. The time data 118 can indicate the delay between adjacent datalink messages. In one example, the time data 118 can comprise a time delay between a first datalink message and a second datalink message. Based on the response data 116, the timer control module 104 can set response delay data 120. The response delay data 120 can include data regarding the time between the receipt of the new datalink message and the response to the new datalink message from the operator of the device 10. The response delay data 120 can also include data regarding the time between the receipt of the new datalink message and a response to a prior datalink message from the operator of the device 10.

The escalation control module 106 can receive as input the sender data 114, the response data 116, the time data 118 and the response delay data 120. The escalation control module 106 can also receive as input accelerometer data 122, GUI data 124 and activity data 126. The accelerometer data 122 can comprise signals received from the first sensor 30 of the device 10, which can indicate if the device 10 is experiencing an acceleration, such that the device 10 is being handled by the operator. The GUI data 124 can include data that indicates whether the graphical user interface that provides the messaging application is active on the device 10. For example, the GUI data 124 can include data that indicates if the messaging application is open or closed. The activity data 126 can include data that indicates if the device 10 is active, or if the device 10 is in a stand-by mode. The activity data 126 can be received from the second sensor 31.

Based on the sender data 114, response data 116, time data 118, response delay data 120, accelerometer data 122, GUI data 124 and activity data 126, the escalation control module 106 can output audible alert data 128 and tactile alert data 130. The escalation control module 106 can also set visual alert data 132 for the GUI manager control module 108. The audible alert data 128 can include a signal that indicates a level for an audible alert to be broadcast to the operator of the device 10 by the audible output device 26. The audible alert data 128 can also include the type of sound to be played by the audible output device 26 as the audible alert, if desired. The tactile alert data 130 can include a signal to activate the tactile output device 28 to produce a tactile alert. The visual alert data 132 can include a graphical and/or textual alert to be displayed on the display 24.

The GUI manager control module 108 can receive as input the visual alert data 132, the message data 115 and user input data 134. The user input data 134 can include data and/or commands received from the operator of the device 10 through the user input device 32. In one example, the user input data 134 can comprise a response to the incoming datalink message. Based on the visual alert data 132, message data 115 and user input data 134, the GUI manager control module 108 can output the visual alert data 132, message data 115 and GUI 136 on the display 24. The GUI 136 can provide an interface for the operator to send one or more datalink messages, and can also provide an interface for the operator to receive one or more datalink messages. In one example, the visual alert data 132 and/or message data 115 can be displayed as or included as graphical and/or textual data represented on the GUI 136. Alternatively, the visual alert data 132 and/or message data 115 can be displayed as a pop-up notification in a separate GUI superimposed over the GUI 136.

Figure 3:
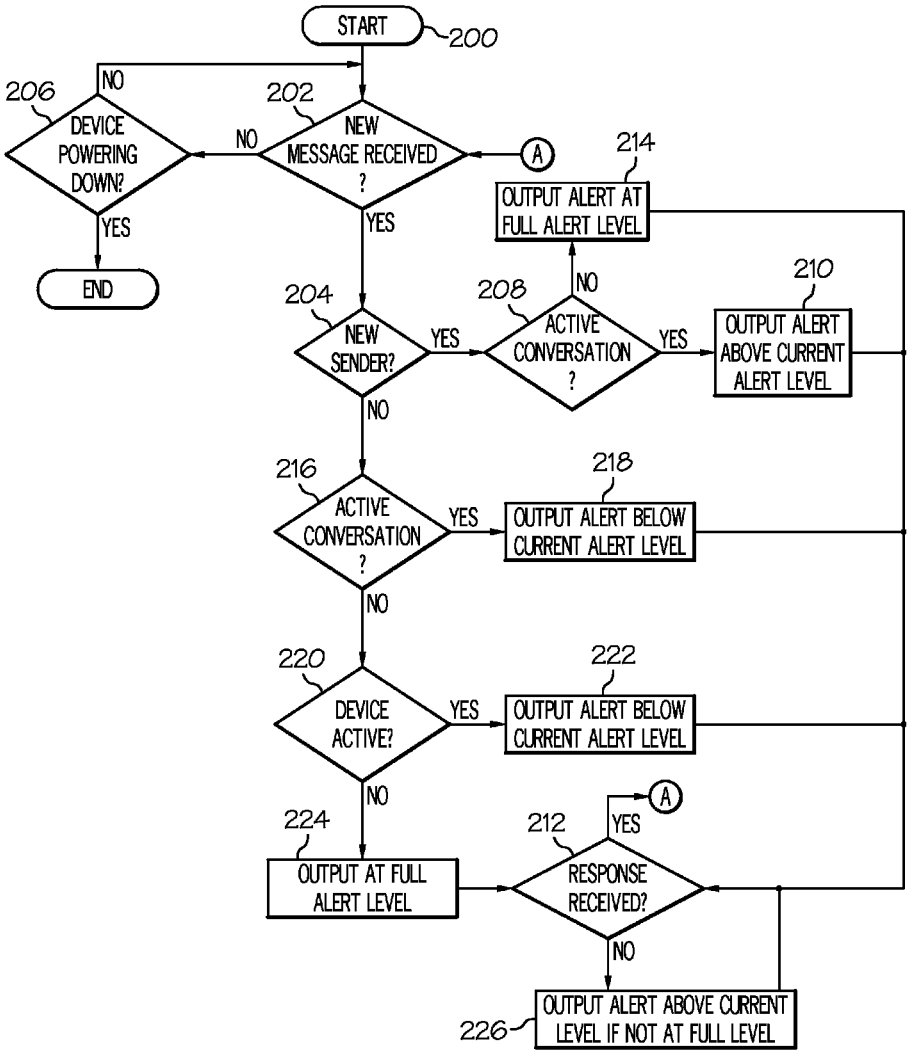
FIG. 3 is a flowchart illustrating a control method of the context sensitive notification system in accordance with an exemplary embodiment.

Referring now to FIG. 3, and with continued reference to FIGS. 1-2, a flowchart illustrates a control method that can be performed by the control module 100 of FIG. 2 in accordance with the present disclosure. As can be appreciated in light of the disclosure, the order of operation within the method is not limited to the sequential execution as illustrated in FIG. 3, but may be performed in one or more varying orders as applicable and in accordance with the present disclosure.

In various embodiments, the method can be scheduled to run based on predetermined events, and/or can run continually during operation of the device 10.

The method can begin at 200. At 202, the method can determine if a new datalink message has been received by the transceiver 34 from the ground station. If a new datalink message has been received, then the method goes to 204. Otherwise, at 206, the method determines if the device 10 is still on based on signals from the second sensor 31. If the device 10 is on, and not powering down, then the method can loop to 202. Otherwise, the method can end.

At 204, the method can determine if the sender of the datalink message is a new sender based on the sender data 114. Generally, the sender is a new sender if the datalink message is received from a sender that is different than the sender of the last received datalink message. If the sender is a new sender, then the method can go to 208. At 208, the method can determine if the operator is engaged in an active exchange or conversation using the device 10. The method can determine if the conversation is active based on the activity data 126 and the response data 116. In this regard, a conversation can generally be considered to be active if the activity data 126 indicates that the messaging application is opened and the operator has responded to a prior datalink message within a predetermined amount of time as indicated by response delay data 120. For example, a suitable response delay can between about 1 minute to about 8 minutes.

If the operator is engaged in an active conversation, then the method at 210 can output an alert at an alert level that is above the current alert level. For example, if the current alert level is the third, lower level alert, then the method can output the alert at the first, full level alert or second, lower level alert. Thus, the method can output audible alert data 128, tactile alert data 130, visual alert data 132 or combinations thereof based on the alert level. Then, the method can go to 212.

If the method determines that the operator is not engaged in an active conversation, then the method can go to 214. At 214, the method can output the alert at the first, full level alert. Then, the method can go to 212.

If, at 204, the sender is not a new sender, the method can determine if the operator is engaged in an active exchange or conversation at 216. As discussed at 208, the conversation can generally be considered to be active if the activity data 126 indicates that the messaging application is opened and the operator has responded to a prior datalink message within a predetermined amount of time based on response delay data 120. If the conversation is active, then the method can output the alert at a level below the current alert level at 218. For example, if the current alert level is the third, lower level alert, then the method can output the alert that a new datalink message has been received at the fourth, lower level alert. Then, the method can go to 212.

If the conversation is not an active conversation, then the method can go to 220. At 220, the method can determine if the device 10 is being handled based on the accelerometer data 122. If the device 10 is being handled, then the method can output the alert at a level below the current alert level at 222. For example, if the current alert level is the third, lower level alert, then the method can output the alert that a new datalink message has been received at the fourth, lower level alert. Then, the method can go to 212.

If the device is not being handled at 220, then the method can output the alert at the first, full level alert at 224. Then, the method can go to 212.

At 212, the method can determine if a response to the new datalink message has been received from the operator to the datalink message within the predetermined delay period based on the response delay data 120. If a response has been received from the operator, then the method can go to 202. Otherwise, the method can output the alert at a level above the current alert level if the current alert level is not the first, full level alert at 226. For example, if the current alert level is the third, lower level alert, then the method can output the alert at the first, full level alert or second, lower level alert. Then, the method can loop to 212.

Those of skill in the art will appreciate that the various illustrative logical blocks, modules, circuits, and algorithm steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure. For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the present disclosure as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment of the present disclosure. It being understood that various changes may be made in the function and arrangement of elements described in an exemplary embodiment without departing from the scope of the present disclosure as set forth in the appended claims.

What is claimed is:

1. A method for context sensitive notifications of incoming digital communications using a device onboard an aircraft for receiving and sending a datalink message, the device including a user input device, the method comprising:

receiving a new datalink message from a sender on the device, the datalink message including a unique identifier associated with the sender;

determining if the sender is a new sender based on the unique identifier;

determining if the device is involved in an active exchange of datalink messages based on activity data associated with the device;

outputting a first alert that the new datalink message has been received at an alert level below a current alert level if the sender is not a new sender and the device is engaged in the active exchange of datalink messages;

determining if a response has been received via the user input device to the new datalink message; and outputting a second alert that the new datalink message has been received at an alert level above a current alert level if no response has been received via the user input device.

2. The method of claim 1, wherein if the sender is a new sender, the method further comprises:

determining if the device is involved in the active exchange of datalink messages based on the activity data associated with the device; and outputting the first alert that the new datalink message has been received at a level above a current alert level if the device is involved in the active exchange of datalink messages.

3. The method of claim 2, wherein if the device is not actively involved in the exchange of datalink messages, the method further comprises:

outputting the first alert that the new datalink message has been received at a full alert level.

4. The method of claim 3, wherein outputting the first alert at the full alert level further comprises:

outputting an audible alert at a maximum value;

outputting a tactile alert; and outputting a visual alert.

5. The method of claim 1, wherein outputting the first alert further comprises:

outputting an audible alert, a visual alert, a tactile alert or combinations thereof.

6. The method of claim 1, wherein if the sender is not a new sender and the device is not involved in the active exchange of datalink messages, the method further comprises:

determining if the device is being actively handled based on a signal from an accelerometer of the device; and outputting the first alert that the new message has been received at an alert level below the current alert level if the device is being actively handled.

7. The method of claim 6, wherein if the device is not being actively handled, the method further comprises:

outputting the first alert that the new datalink message has been received at a full alert level.

8. The method of claim 1, wherein outputting the second alert that the new datalink message has been received if no response has been received via the user input device further comprises:

outputting the second alert after a predetermined delay period.

9. The method of claim 1, wherein determining if the device is actively involved in the active exchange of datalink messages further comprises:

determining if a messaging application is open on the device; and determining if a response has been received to a prior datalink message within a predetermined period of time.

10. The method of claim 1, wherein determining if the sender is a new sender further comprises:

determining if the sender of the new datalink message is different than a sender of a last datalink message received by the device.

11. A computer program product for processing a digital signal, comprising:

a tangible storage medium readable by a processing circuit and storing instructions for execution by the processing circuit for performing a method comprising:

receiving a new datalink message having a unique sender identifier;

determining if the sender is a new sender based on the unique sender identifier;

determining if an active exchange of datalink messages is occurring on a device;

determining if the device is active; and outputting an alert that the new datalink message has been received at an alert level below a current alert level if an active exchange of datalink messages is not occurring, the sender is not a new sender and the device is active.

12. The computer program product of claim 11, further comprising:

determining if a response has been received to the new datalink message; and outputting a second alert at an alert level above the current alert level if no response has been received within a predetermined delay period.

13. The computer program product of claim 11, further comprising:

outputting the alert that the new datalink message has been received at a full alert level if an active exchange of datalink messages is occurring, the sender is not a new sender and the device is not active.

14. The computer program product of claim 11, further comprising:

determining if the device is active based on a signal from an accelerometer of the device.

15. The computer program product of claim 13, wherein outputting the alert at the full alert level further comprises:

outputting an audible alert at a maximum value;

outputting a tactile alert; and outputting a visual alert.

16. A method for context sensitive notifications of incoming digital communications on an aircraft comprising:

providing a device on an aircraft for receiving and sending a datalink message, the device including a user input device and an accelerometer;

receiving a new datalink message from a sender on the device, the datalink message including a unique identifier associated with the sender;

determining if the sender is a new sender based on the unique identifier;

determining if the device is involved in an active exchange of datalink messages based on activity data associated with the device;

determining if the device is active based on data received from the accelerometer;

outputting a first alert that the new datalink message has been received at a full alert level if the sender is not a new sender, the device is not engaged in the active exchange of datalink messages and the device is not active;

determining if a response has been received via the user input device to the new datalink message; and outputting a second alert that the new datalink message has been received if no response has been received via the user input device after a predetermined delay period.

17. The method of claim 16, wherein outputting the second alert further comprises:

outputting the second alert at the full alert level.

18. The method of claim 17, wherein outputting the second alert at the full alert level further comprises:

outputting an audible alert at a maximum value;

outputting a tactile alert; and outputting a visual alert.

19. The method of claim 18, further comprising:

outputting the first alert that the new message has been received at an alert level below a current alert level if the sender is not a new sender, the device is not engaged in the active exchange of datalink messages and the device is active.

20. The method of claim 19, wherein outputting the second alert that the new datalink message has been received if the device is active further comprises:

outputting the second alert at an alert level above the current alert level.

* * * * *